US006014622A

United States Patent [19]

Su et al.

[11] Patent Number: 6,014,622

[45] Date of Patent: Jan. 11, 2000

[54] LOW BIT RATE SPEECH CODER USING ADAPTIVE OPEN-LOOP SUBFRAME PITCH LAG ESTIMATION AND VECTOR QUANTIZATION

[75] Inventors: Huan-Yu Su, San Clemente, Calif.; Tom Hong Li, Grayslake, Ill.

[73] Assignee: Rockwell Semiconductor Systems, Inc., Newport Beach, Calif.

[21] Appl. No.: 08/721,410

[22] Filed: Sep. 26, 1996

[51] Int. Cl.[7] ..... G10L 9/14

[52] U.S. Cl. ..... 704/223; 704/207; 704/219

[58] Field of Search ..... 704/219, 207, 704/223, 262, 264

[56] References Cited

U.S. PATENT DOCUMENTS

| | | | |
|---|---|---|---|
| 5,307,441 | 4/1994 | Tzeng | 704/222 |
| 5,414,796 | 5/1995 | Jacobs et al. | 704/221 |
| 5,495,555 | 2/1996 | Swaminathan | 704/207 |
| 5,596,676 | 1/1997 | Swaminathan et al. | 704/208 |
| 5,600,754 | 2/1997 | Gardner et al. | 704/221 |

OTHER PUBLICATIONS

Andreas S. Spanias, "Speech Coding: A Tutorial Review", Proc. IEEE, vol. 82, No. 10, p. 1541–1582, Oct. 1994.

*Primary Examiner*—David R. Hudspeth
*Assistant Examiner*—Tālivaldis Ivars Šmits
*Attorney, Agent, or Firm*—Akin Gump Strauss Hauer & Feld

[57] ABSTRACT

A pitch lag coding device and method using interframe correlation inherent in pitch lag values to reduce coding bit requirements. A pitch lag value is extracted for a given speech frame, and then refined for each subframe. For every speech frame having N samples of speech, LPC analysis and vector quantization are performed for the whole coding frame. The LPC residual obtained for each frame is then processed such that pitch lag values for all subframes within the coding frame are analyzed concurrently. The remaining coding parameters, i.e., the codebook search, gain parameters, and excitation signal, are then analyzed sequentially according to their respective subframes.

3 Claims, 5 Drawing Sheets

LOW BIT RATE SPEECH CODER USING ADAPTIVE OPEN-LOOP SUBFRAME PITCH LAG ESTIMATION AND VECTOR QUANTIZATION

BACKGROUND OF THE INVENTION

Speech signals can usually be classified as falling within either a voiced region or an unvoiced region. In most languages, the voiced regions are normally more important than unvoiced regions because human beings can make more sound variations in voiced speech than in unvoiced speech. Therefore, voiced speech carries more information than unvoiced speech. To be able to compress, transmit, and decompress voiced speech with high quality is thus the forefront of modern speech coding technology.

It is understood that neighboring speech samples are highly correlated, especially for voiced speech signals. This correlation represents the spectrum envelop of the speech signal. In one speech coding approach called linear predictive coding (LPC), the value of the digitized speech sample at any particular time index is modeled as a linear combination of previous digitized speech sample values. This relationship is called prediction since a subsequent signal sample is thus linearly predictable according to earlier signal values. The coefficients used for the prediction are simply called the LPC prediction coefficients. The difference between the real speech sample and the predicted speech sample is called the LPC prediction error, or the LPC residual signal. The LPC prediction is also called short-term prediction since the prediction process takes place only with few adjacent speech samples, typically around 10 speech samples.

The pitch also provides important information in the voiced speech signals. One might already have experienced that by varying the pitch using a tape recorder, a male voice may be modified or sped up, to sound like a female voice, and vice versa, since the pitch describes the fundamental frequency of the human voice. Pitch also carries voice intonations which are useful for manifesting happiness, anger, questions, doubt, etc. Therefore, precise pitch information is essential to guarantee good speech reproduction.

For speech coding purposes, the pitch is described by the pitch lag and the pitch prediction coefficient (or pitch gain). A further discussion of pitch lag estimation is described in copending application entitled "Pitch Lag Estimation System Using Frequency-Domain Lowpass Filtering of the Linear Predictive Coding (LPC) Residual," Ser. No. 08/454,477, filed May 30, 1995, invented by Huan-Yu Su, and now allowed, the disclosure of which is incorporated herein by reference. Advanced speech coding systems require efficient and precise extraction (or estimation) of the LPC prediction coefficients, the pitch information (i.e. the pitch lag and the pitch prediction coefficient), and the excitation signal from the original speech signal, according to a speech reproduction model. The information is then transmitted through the limited available bandwidth of the media, such as a transmission channel (e.g., wireless communication channel) or storage channel (e.g., digital answering machine). The speech signal is then reconstructed at the receiving side using the same speech reproduction model used at the encoder side.

Code-excited linear-prediction (CELP) coding is one of the most widely used LPC based speech coding approaches. A speech regeneration model is illustrated in FIG. 1. The gain scaled (via 116) innovation vector (115) output from a prestored innovation codebook (114) is added to the output of the pitch prediction (112) to form the excitation signal (120), which is then filtered through the LPC synthesis filter (110) to obtain the output speech.

To guarantee good quality of the reconstructed output speech, it is essential for the CELP decoder to have an appropriate combination of LPC filter parameters, pitch prediction parameters, innovation index, and gain. Thus, determining the best parameter combination that minimizes the perceptual difference between the input speech and the output speech is the objective of the CELP encoder (or any speech coding approach). In practice, however, due to complexity limitations and delay constraints, it has been found to be extremely difficult to exhaustively search for the best combination of parameters.

Most proposed speech codecs (coders/decoders) operating at a medium to low bit-rate 4–16 kbits/sec) group digitized speech samples in blocks (10–40 msec), each block being called a speech coding frame. As described in FIG. 2, after preprocessing (210), LPC analysis and quantization (212) are performed once per coding frame, while pitch analysis (214) and innovation signal (code vector) analysis (224) are performed once per subframe (216) (2–8 msec). Typically, each frame includes two to four subframes. This frame and subframe approach is based upon the observation that the LPC information is more slowly changing in speech as compared to the pitch information or the innovation information. Therefore, the minimization of the global perceptually weighted coding error is replaced by a series of lower dimensional minimizations over disjoint temporal intervals. This procedure results in a significantly lower complexity requirement to realize a CELP speech coding system. However, the drawback to this frame and subframe approach is that the pitch lag information is generally determine and scalar quantized in each successive subframe such that the bit-rate required to transmit the pitch lag information is too high for low bit-rate applications. For example, a typical rate of 1.3 kbits/sec is usually necessary to provide adequate pitch lag information to maintain good speech reproduction. Although such a requirement in bandwidth is not difficult to satisfy in speech coding systems operating at a bit-rate of 8 kbits/sec or higher, using 1.3 kbits/sec to transmit pitch lag information alone is excessive for low bit-rate coding applications operating, for example, at 4 kb/s.

In the low bit-rate speech coding field, advanced high quality parameter quantization schemes are widely used and have become essential. Vector quantization (VQ) is one of the most important contributors to achieve low bit-rate speech coding. In comparison to the simple scalar quantization (SQ) scheme, VQ results in much better quality at the same bit-rate, or same quality at much lower bit-rate. Unfortunately, VQ is not applicable to the pitch lag information quantization according to the current CELP speech coding model. To better explain this idea, the parameter generation procedure for the pitch lag in a CELP coder will be examined below.

Referring back to FIG. 2, it can be seen during the pitch analysis at (214) that the conventional pitch prediction procedure in a CELP coder is a feed back process, which takes past excitation signals from past subframes as an input to the pitch prediction module, and produces a pitch contribution vectors $E_{LAG}$. Since pitch prediction models the low periodicity of the speech signal, it is also called long-term prediction because the prediction terms are longer than those of LPC. For a given subframe, the pitch lag ("Lag") is searched around a range, typically between 18 and 150 speech samples to cover the majority of speech variations of the human being. The search is performed according to a searching step distribution. This distribution is predetermined by a compromise between high temporal resolution and low bit-rate requirements.

For example, in the North American Digital Cellular Standard IS-54, the pitch lag searching range is predetermined to be from 20 to 146 samples and the step size is one sample, e.g., possible pitch lag choices around 30 are 28, 29, 30, 31, and 32. Once the optimal pitch lag is found, there is an index associated with its value, for example, 29. In another speech coding standard, the International Telecommunication Union (ITU) G.729 speech coding standard, the pitch lag searching range is set to be [19⅓,143], and a step size of ⅓ is used in the range of [19⅓,84⅔]. Accordingly, possible pitch lag values around 30 may be 29, 29⅓, 29⅔, 30, 30⅓, 30⅔, 31, etc. In some cases, a non-integer pitch lag (e.g. 29⅓) is more suitable for a current speech subframe than an integer pitch lag (e.g. 29).

Once the best pitch lag ("Lag") is found (218) for the current speech subframe, a pitch prediction coefficient β and a pitch prediction contribution e(n-Lag) may be determined (220). Taking the pitch prediction coefficient β into account, the innovation codebook analysis (224) can be performed in that the determination of the innovation code vector $C_i$ depends on the pitch prediction coefficient B of the current subframe. The current excitation signal e(n) for the subframe (228) is the gain scaled linear combination of two contributions (the codebook contribution and the pitch prediction contribution) and it will be the input signal for the next pitch analysis (214), and so forth for subsequent subframes (230), (232). As is well-known, this parameter determination procedure, also called closed-loop analysis, becomes a causal system. That is, the determination of a particular subframe's parameters depends on the parameters of the immediately preceding subframes. Thus, once the parameters for subframe i, for example, are selected, their quantization will impact the parameter determination of the subsequent subframe i+1. The drawback of this approach, however, is that the sets of parameters have a high level of dependence on each other. Once the parameters for subframe i+1 are determined, the parameters for the previous subframe i cannot be modified without harmfully impacting the speech quality. Consequently, because the vector quantization is not a lossless quantization scheme, the pitch lags obtained by this extraction scheme must be scalar quantized, resulting in low quantization efficiency.

Furthermore, in a typical CELP coding system, the encoder requires extraction of the "best" excitation signal or, equivalently, the best set of the parameters defining the excitation signal for a given subframe. This task, however, is functionally infeasible due to computational considerations. For example, it is well understood that coded speech of reasonable quality requires the availability of at least 50α values, 20β values, 200 pitch lag ("Lag") values, and 500 codevectors. The G.729 and G.723. 1 Standards require even more values. Moreover, this evaluation should be performed at subframe frequency on the order of about 200/second. Consequently, it can readily be determined that a straight forward evaluation approach requires more than $10^{10}$ vector operations per second.

SUMMARY OF THE INVENTION

Accordingly, it is an object of the present invention to provide a scheme for very low bit rate coding of pitch lag information incorporating a modified pitch lag extraction process, and an adaptive weighted vector quantization, requiring a low bit-rate and providing greater precision than past systems. In particular embodiments, the present invention is directed to a device and method of pitch lag coding used in CELP techniques, applicable to a variety of speech coding arrangements.

These and other objects are accomplished, according to an embodiment of the invention, by a pitch lag estimation and coding scheme which quickly and efficiently enables the accurate coding of the pitch lag information, thereby providing good reproduction and regeneration of speech. According to embodiments of the present invention, accurate pitch lag values are obtained simultaneously for all subframes within the current coding frame. Initially, the pitch lag values are extracted for a given speech frame, and then refined for each subframe.

More particularly, for every speech frame having N samples of speech, LPC analysis is performed. LPC analysis and filtering are performed for the coding frame. The LPC residual obtained for the frame is then processed to provide pitch lag estimation and LPC vector quantization for each subframe. The estimated pitch lag values for all subframes within the coding frame are analyzed in parallel. The remaining coding parameters, i.e., the codebook search, gain parameters, and excitation signal, are then analyzed sequentially for each subframe. As a result, by taking advantage of the strong interframe correlation of the pitch lag, efficient pitch lag coding can be performed with high precision at a substantially low bit rate.

DETAILED DESCRIPTION OF THE PREFERRED EMBODIMENTS

Based on linear prediction theory, digitized speech signals at a particular time can be simply modeled as the output of a linear prediction filter, excited by an excitation signal. Therefore, an LPC-based speech coding system requires extraction and efficient transmission (or storage) of the synthesis filter 1/A(z) and the excitation signal e(n). The frequency of how often these parameters are updated typically depends on the desired bit-rate of the coding system and the minimum requirement of the updating rate to maintain a desired speech quality. In preferred embodiments of the present invention, the LPC synthesis filter parameters are quantized and transmitted once per predetermined period, such as a speech coding frame (5 to 40 ms), while the excitation signal information is updated at higher frequency (2.5 to 10 ms).

The speech encoder must receive the digitized input speech samples, regroup the speech samples according to the frame size of the coding system, extract the parameters from the input speech and quantize the parameters before transmission to the decoder. At the decoder, the received information will be used to regenerate the speech according to the reproduction model.

Figure 3A:
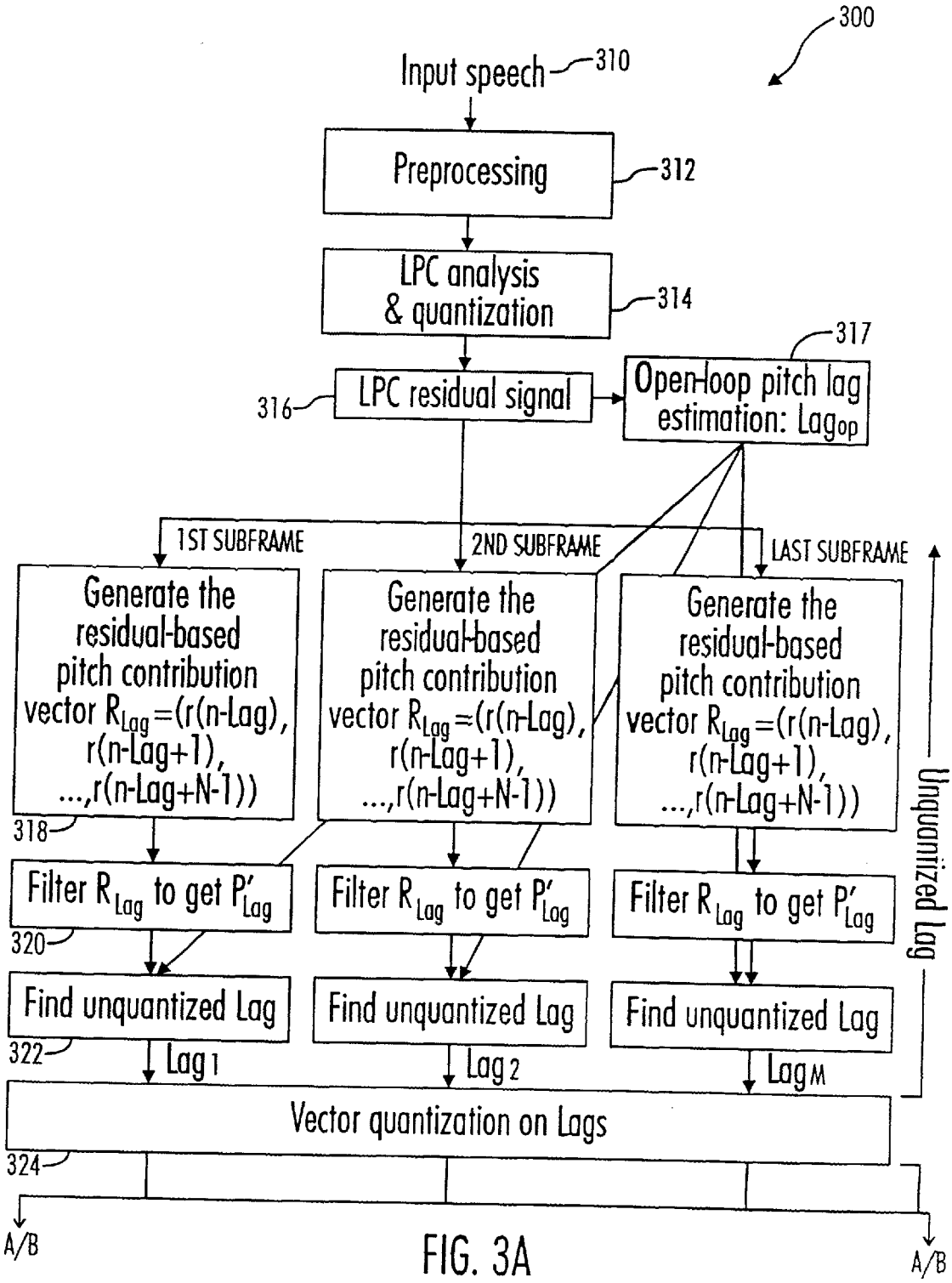
FIG. 3 is a block diagram of a speech coder in accordance with preferred embodiments of the present invention.
Figure 3B:
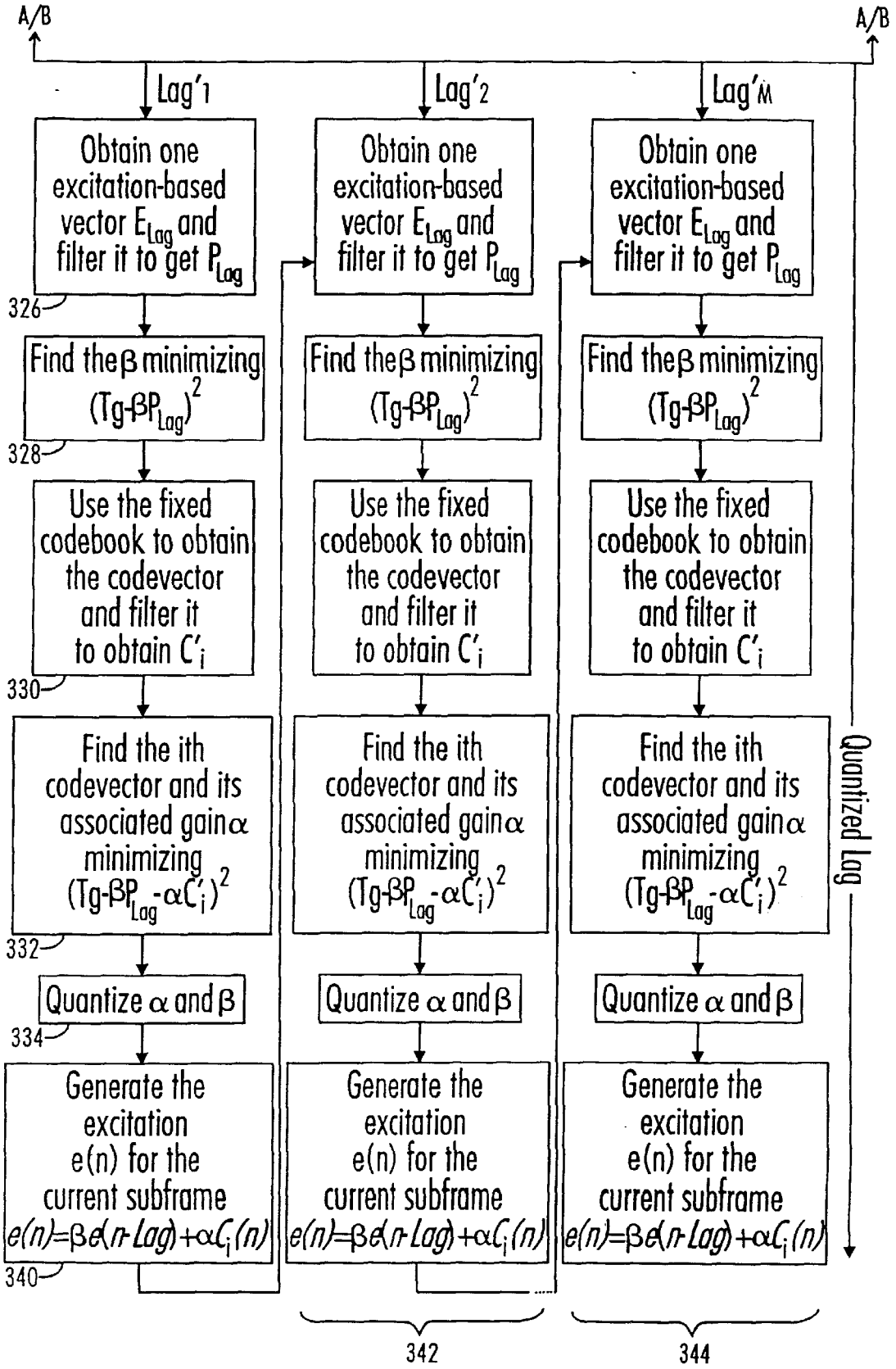

A speech coding system or encoder (300) in accordance with a preferred embodiment of the present invention is shown in FIG. 3. Input speech (310) is stored and processed frame-by-frame in the encoder (300). In certain embodiments, the length of each unit of processing, i.e., the coding frame length, is 15 ms such that one frame consists of 120 speech samples at an 8 kHz sampling rate, for example. Preferably, the input speech signal (310) is preprocessed (312) through a high-pass filter. LPC analysis and LPC quantization (314) can then be performed to get the LPC synthesis filter which is represented by a plurality of LPC prediction coefficients $a_1, a_2, \ldots, a_{np}$ which define the equation:

$$A(z)=1-a_1z^{-1}-a_2z^{-2}-\ldots-a_{np}z^{-np}$$

where the nth sample can be predicted by $$\hat{y}(n)=\sum_{k=1}^{np} a_k * y(n-k).$$

The value np is the number of previous pulses considered or "LPC prediction order" (typically around 10), y(n) is sampled speech data, and n represents the time index. The LPC equations describe the estimation (or prediction) $\hat{y}(n)$ of the current sample y(n) according to the linear combination of the past samples. The difference between the estimated sample $\hat{y}(n)$ and the actual sample y(n) is called the LPC residual r(n), where:

$$r(n)=y(n)-\hat{y}(n)=y(n)-\sum_{k=1}^{np} a_k y(n-k)\text{-}.$$

The LPC prediction coefficients $a_1, a_2, \ldots, a_{np}$ are quantized and used to predict the signal, where np represents the LPC order. In accordance with the present invention, it has been found that the LPC residual signal is ideal for use as an excitation signal since, with such an excitation signal, the original input speech signal can be obtained as the output of the synthesis filter:

$$y(n)=\hat{y}(n)+r(n)=r(n)+\sum_{k=1}^{np} a_k y(n-k),$$

even though it would otherwise be very difficult to transmit such an excitation signal at a low bandwidth. In fact, the bandwidth required for transmitting the LPC residual signal r(n) as an excitation to obtain the original signal is actually higher than the bandwidth needed to transmit the original speech signal; each original speech sample y(n) is usually PCM formatted at 12–16 bits/sample, while the LPC residual r(n) is usually a floating point value and therefore requires more precision than 12–16 bits/sample.

Once the LPC residual signal r(n) (316) is obtained, the excitation signal e(n) can ultimately be derived 340. The resultant excitation signal e(n) is generally modeled as a linear combination of two contributions:

$$e(n)=\alpha\, c(n)+\beta\, e(n-Lag).$$

The contribution c(n) is called codebook contribution or innovation signal which is obtained from a fixed codebook or pseudo-random source (or generator), and e(n-Lag) is the so-called pitch prediction contribution with "Lag" as the control parameter called pitch lag. The parameters α and β are the codebook gain and pitch prediction coefficient (sometimes called pitch gain), respectively. This particular form of modeling the excitation signal e(n) describes the term for the corresponding coding technique: Code-Excited Linear Prediction (CELP) coding. Although the implementation of embodiments of the present invention is discussed with regard to the CELP coding system, preferred embodiments are not limited only to CELP applications.

In the preceding formula, the current excitation signal e(n) is predicted from a previous excitation signal e(n-Lag). This approach of using a past excitation to achieve the pitch prediction parameter extraction is part of the analysis-by-synthesis mechanism, where the encoder has an identical copy of the decoder. Therefore, the behavior of the decoder is considered at the parameter extraction phase. An advantage of this analysis-by-synthesis approach is that the perceptual impact of the coding degradation is considered in the extraction of the parameters defining the excitation signal. On the other hand, a drawback in the conventional implementation of analysis-by-synthesis is that the extraction has to be performed in subframe sequence. That is, for each subframe, the best pitch lag ("Lag") is first found according to the predetermined scalar quantization scale, then the associated pitch gain β is computed for the chosen pitch lag ("Lag"), and then the best codevector c and its associated gain α, given the pitch lag ("Lag") and the pitch gain β, are determined.

Figure 1:
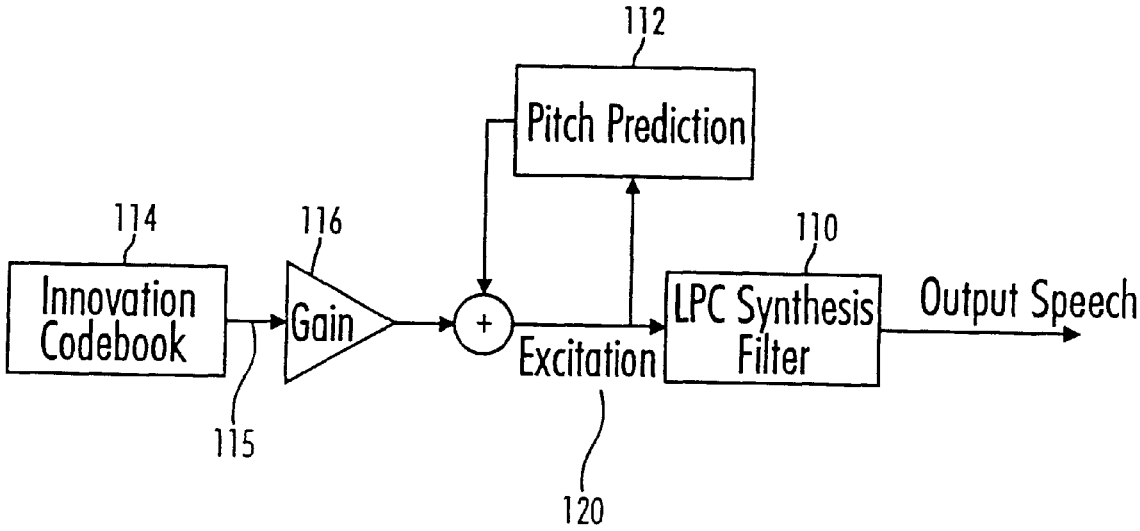
FIG. 1 PRIOR ART
FIG. 1 is a block diagram of a CELP speech model.
Figure 2A:
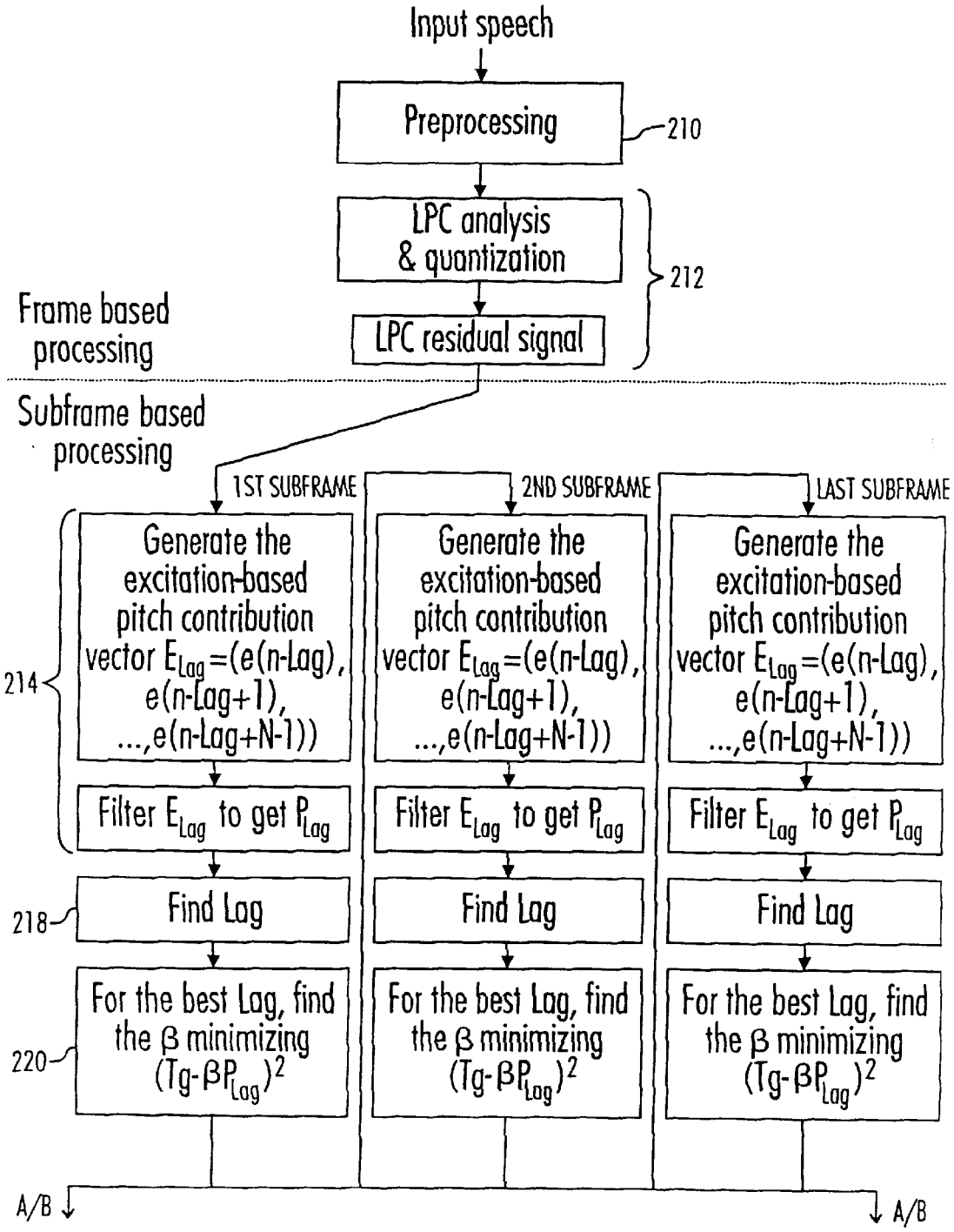
FIG. 2A PRIOR ART
FIG. 2 is a block diagram of a conventional CELP model.
Figure 2B:
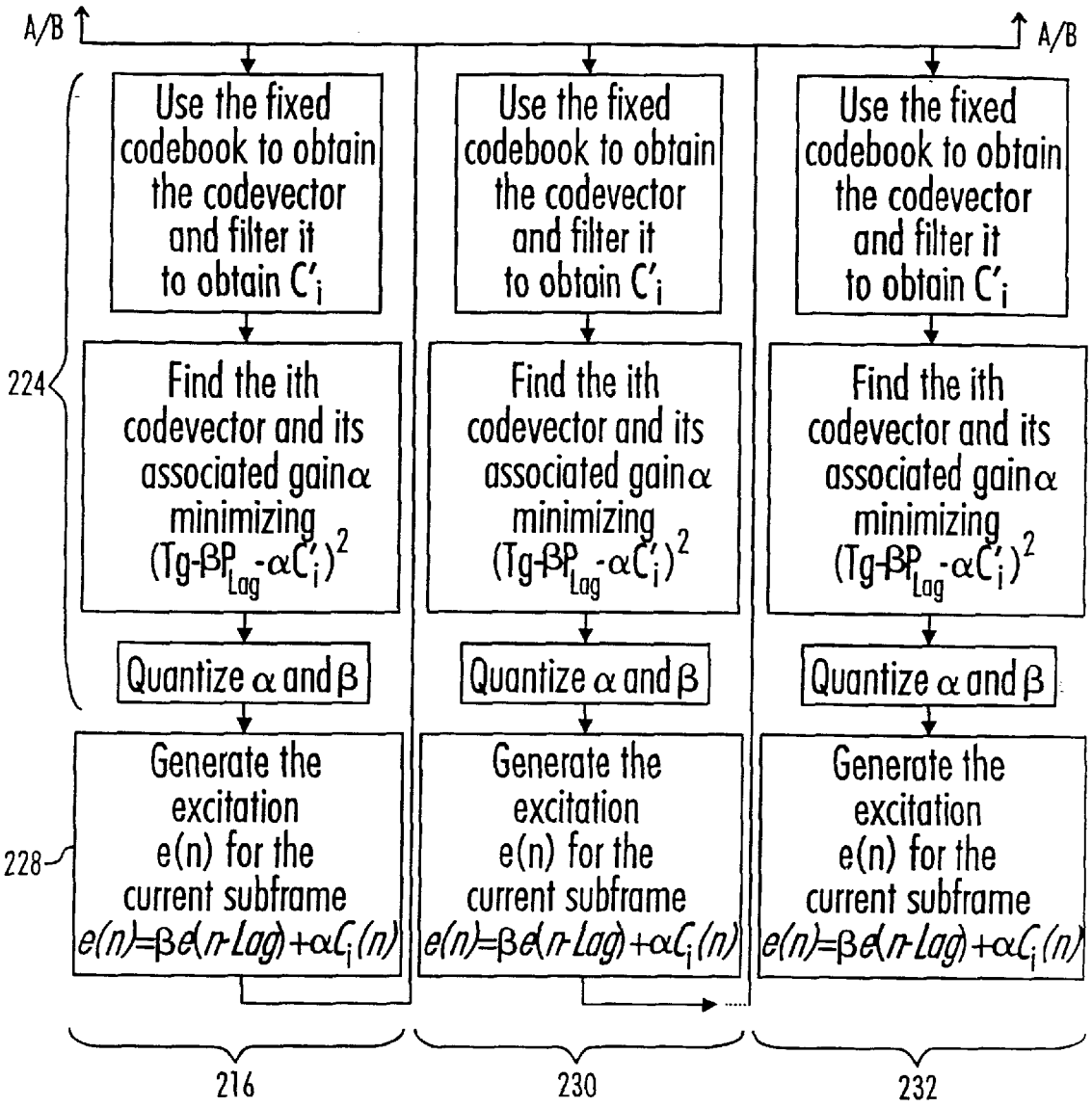
FIG. 2B PRIOR ART

In accordance with preferred embodiments of the present invention, however, unquantized pitch lag values ($Lag_1$, $Lag_2$, etc . . . ) are simultaneously obtained for all subframes in the coding frame through an adaptive open-loop searching approach. That is at (318) and (320), each subfra simultaneously uses the LPC residual signals r(n) instead of iteratively using the past excitation signals e(n) to perform the pitch prediction analysis. An "unquantized lag vector" of unquantized pitch lag values ($Lag_1$, $Lag_2$, etc . . . ) is then constructed (322) and vector quantization (324) is applied to the unquantized lag vector to obtain a vector quantized lag vector. A vector quantized pitch lag ($Lag'_1$, $Lag'_2$, etc . . . ) is thus determined for each subframe and fixed by the quantized lag vector (324). Processing now proceeds in a subframe-by-subframe basis. In particular, starting with the first subframe, a pitch contribution vector $E_{LAG}$ defined by the vector quantized pitch lag ($Lag'_1$) is constructed (326) and filtered to obtain a perceptually filtered pitch contribution vector $P_{Lag}$ for the first subframe. The corresponding β (328), the codevector $c_i$ (330) and the gain α (332), can now be found as described above with reference to FIG. 2.

More particularly, the adaptive open-loop searching technique and the usage of a vector quantization scheme (324) to achieve low bit-rate pitch lag coding are as follows:

(1) Referring still to FIG. 3, the LPC residual signal r(n) (316) for the coding frame is used to determine a fixed open-loop pitch lag $Lag_{op}$ (317), using the pitch lag estimation method, as discussed in the Background section above. Other methods of open-loop pitch lag estimation can also be used to determine the open-loop pitch lag $Lag_{op}$.

(2) Concurrently, in preferred embodiments, an LPC residual signal vector R (316) is constructed for use by each subframe according to:

$$R=(r(n),r(n+1),\ldots,r(n+N-1))$$

where n is the first sample of the subframe. This LPC residual signal vector R is filtered through a synthesis filter 1/A(z) (not indicated in the figure), and then through a perceptual weighting filter W(z), which takes the general form:

$$W(z) = \frac{A(z/\gamma_1)}{A(z/\gamma_2)}(1 - \lambda z^{-\text{lag}})$$

where $0 \leqq \gamma_2 \leqq \gamma_1 \leqq 1$ are control factors, and $0 \leqq \gamma \leqq 1$, to obtain a target signal Tg for that subframe.

(3) A single pitch lag "Lag" $\epsilon$[min Lag, max Lag] is considered, where minLag and maxLag are the minimum-allowed pitch lag and the maximum-allowed pitch lag values in a particular coding system. A residual-based pitch prediction, or excitation, vector $R_{Lag}$ is then obtained (318) using the past LPC residual signal which is immediately available for all the subframes, instead of the past excitation signal which is not available for all the subframes with exception of the first subframe as mentioned before, such that:

$$R_{Lag}=(r(n-Lag),r(n-Lag+1), \ldots , r(n-Lag+N-1))$$

where N is the subframe length in samples. This pitch prediction vector $R_{Lag}$ is filtered (320) through W(z)/A(z) to obtain the perceptually filtered pitch prediction vector $P_{Lag}$. At (322), the following equation is used to determine the unquantized pitch lag ($Lag_1$, $Lag_2$, etc . . . ) for the current subframe:

$$\text{Lag} = \text{Arg}\left[\underset{\text{Lag}\in[\text{MinLag,maxLag}]}{\text{Max}} \frac{Tg \cdot P'_{\text{Lag}}}{\|P'_{\text{Lag}}\|^2}\right].$$

In practice, due to complexity concerns, the open-loop pitch lag $Lag_{op}$ (317) obtained in step (1) is applied to limit the searching range. For example, instead of searching through [minLag, maxLag], the search may be limited between [$Lag_{op}$−3, $Lag_{op}$+3]. It has been found that such a two-step searching procedure significantly reduces the complexity of the pitch prediction analysis.

(4) Once the unquantized pitch lag ($Lag_i$) for each subframe in the current coding frame is obtained 322, an unquantized pitch lag vector can be obtained:

$$V_{Lag}=[Lag_1, Lag_2, \ldots Lag_M]$$

where $Lag_i$ is the unquantized pitch lag from the subframe i, and M is the number of subframes in one coding frame.

(5) A vector quantizer (324) is used to quantize the unquantized lag vector $V_{Lag}$. A variety of advanced vector quantization (VQ) schemes may be implemented to achieve high performance vector quantization. Preferably, to realize a high quality quantization, a high quality pre-stored quantization table is critical. The structure of the vector quantizer, for example, may comprise multi-stage VQ, split VQ, etc., which can all be used in different instances to achieve different requirements of complexity, memory usage, and other considerations. For example, the one-stage direct VQ is considered here. After the vector quantization, a quantized pitch lag vector is obtained at (324):

$$V'_{Lag}=[Lag'_1, Lag'_2, \ldots , Lag'_M].$$

quantized pitch lag ($Lag'_i$) for each subframe will be used by the speech codec, as discussed in detail above. The iterative subframe analysis can then continue for each consecutive subframe in the frame.

(6) Now, using known coding techniques, the pitch contribution vector $E_{Lag}$ using the quantized pitch lag ($Lag'_i$) and past excitation signal (rather than the LPC residual signal) is obtained (326):

$$E_{Lag}=(e(n-Lag),e(n-Lag+1), \ldots ,e(n-Lag+N-1))$$

This pitch contribution vector $E_{Lag}$ is filtered through W(z)/A(z) to obtain the perceptually filtered pitch contribution vector $P_{Lag}$. The optimal pitch prediction coefficient β is determined (328) according to:

$$\beta = \frac{Tg \cdot P_{Lag}^T}{P_{Lag} \cdot P_{Lag}^T}$$

which minimizes the error criteria:

$$error_{Lag}=(Tg-\beta P_{Lag})^2$$

where Tg is the target signal which represents the perceptually filtered input signal.

Using the fixed codebook to obtain the $j^{th}$ codevector $C_j$ 330, the codevector is filtered through W(z)/A(z) to determine $C'_j$. The best codevector $C_i$ and its associated gain α can be found (332) by minimizing:

$$[C_i, \alpha] = \text{Arg}\left[\underset{j\in[0,N_c],\alpha}{\text{Min}} (T_g - \beta P_{Lag} - \alpha C'_j)^2\right],$$

where Nc is the size of the codebook (or the number of the codevectors). The codevector gain α and the pitch prediction gain β are then quantized (334) and applied to generate the excitation e(n) for the current subframe (340) according to:

$$e(n)=\beta e(n-Lag)+\alpha C_i(n).$$

The excitation sequence e(n) of the current subframe is retained as part of the past excitation signal to be applied to the subsequent subframes (342), (344). The coding procedure will be repeated for every subframe of the current coding frame.

(7) At the speech decoder, LPC coefficients $a_k$, the vector quantized pitch lag ($Lag'_i$), the pitch prediction gain β, the codevector index i, and the codevector gain α are retrieved, by reverse quantization, from the transmitted bit stream. The excitation signal for each subframe is simply repeated as performed in the encoder:

$$e(n)=\beta e(n-Lag)+\alpha C_i(n).$$

Accordingly, the output speech is ultimately synthesized by:

$$\tilde{y}(n) = e(n) + \sum_{k=1}^{np} a_k * \tilde{y}(n-k).$$

What is claimed is:

1. A system for coding speech, the speech being represented as plural speech samples segregated into a frame, the frame being formed of a plurality of subframes, wherein linear predictive coding (LPC) analysis and quantization of the speech samples in the frame are performed to determine an LPC residual signal, the system comprising:

lag means for estimating an unquantized pitch lag value within a predetermined minimum-allowed pitch lag and a predetermined maximum-allowed pitch lag for each subframe within the frame, including;

means for constructing an LPC residual signal vector for the frame of speech, means for estimating an open-loop pitch lag value based on the LPC residual signal vector, the open-loop pitch lag value lying within the predetermined minimum-allowed pitch lag and the predetermined maximum-allowed pitch lag:

a synthesis filter for filtering the LPC residual signal vector to produce a target signal;

means for generating a residual-based pitch contribution vector for each subframe within the frame;

means for perceptually filtering each residual-based pitch contribution vector to obtain a perceptually-filtered residual-based pitch contribution vector; and means for estimating the unquantized pitch lag value for each subframe by considering a plurality of pitch lag values that are located around the open-loop pitch lag value within a subset of values that are within the predetermined minimum and maximum-allowed pitch lags and determining which corresponds to a perceptually-filtered residual-based pitch contribution vector that is closest to the target signal;

means for obtaining an unquantized pitch lag vector comprising the unquantized pitch lag values for each subframe within the frame;

a vector quantizer for quantizing the unquantized pitch lag vector to generate a quantized pitch lag vector containing quantized pitch lag values corresponding to each subframe;

means for determining an excitation-based pitch contribution vector for a current subframe based on the corresponding quantized pitch lag vector;

codebook means for generating an excitation signal representative of the speech samples of the current subframe; and means for applying the excitation signal of each current subframe to subsequent subframes to provide coded speech for the frame.

2. The system of claim 1, wherein the codebook means comprises a codebook having plural codevectors individually representative of characteristics of the speech, each codevector having an associated gain, further wherein the codevector which best represents the speech samples in the current subframe is selected to generate the excitation signal.

3. The system of claim 2, further comprising:

means for transmitting the coded speech;

a decoder for receiving and processing the coded speech, the decoder including:

means for retrieving the vector quantized pitch lag, the pitch prediction coefficient, and the codevector and gain;

means for reverse quantizing the retrieved vector quantized pitch lag, the pitch prediction coefficient, and the codevector and gain to produce synthesized speech.

* * * * *